United States Patent [19]

Starkweather et al.

[11] Patent Number: 4,779,742

[45] Date of Patent: Oct. 25, 1988

[54] ARTICLE HOLDER

[76] Inventors: Kimbrough T. Starkweather; Allison M. Brush, both of 2204 Summerpark Ct., Thousand Oaks, Calif. 91362

[21] Appl. No.: 79,941

[22] Filed: Jul. 31, 1987

[51] Int. Cl.[4] ..... A47F 7/00

[52] U.S. Cl. ..... 211/13; 211/88; 211/71

[58] Field of Search ..... 211/88, 38, DIG. 1, 211/55, 71, 87, 13, 10; 248/206.5; 206/214, 282, 292

[56] References Cited

U.S. PATENT DOCUMENTS

| | | | |
|---|---|---|---|
| D. 191,924 | 12/1961 | Meade | 211/88 X |
| 1,747,010 | 2/1930 | Keller | 211/55 |
| 1,949,792 | 3/1934 | Etherton | 211/88 X |
| 2,942,925 | 6/1960 | Behling | 211/88 X |
| 3,182,809 | 5/1965 | Getoor | 211/88 |
| 4,100,684 | 7/1978 | Berger | 211/88 X |

*Primary Examiner*—Reinaldo P. Machado
*Assistant Examiner*—Sarah A. Lechok Eley
*Attorney, Agent, or Firm*—Jack C. Munro

[57] ABSTRACT

An article holder in the form of a flexible walled bag or pouch which is adapted to hold personal articles of a human being such as pens, pencils, combs, coins and the like. The pouch has an enlarged interior chamber within which is mounted a plurality of smaller sized pockets. Each pocket is designed primarily to retain a particular type of article. The back wall of the pouch has mounted thereon a sheet magnet which facilitates quick and easy secure attachment to the vertical side wall surface of a metallic locker. The pockets oriented within the enlarged interior chamber may be fixedly secured to the back wall of the pouch or may be mounted to be movable to various positions or locations.

5 Claims, 1 Drawing Sheet

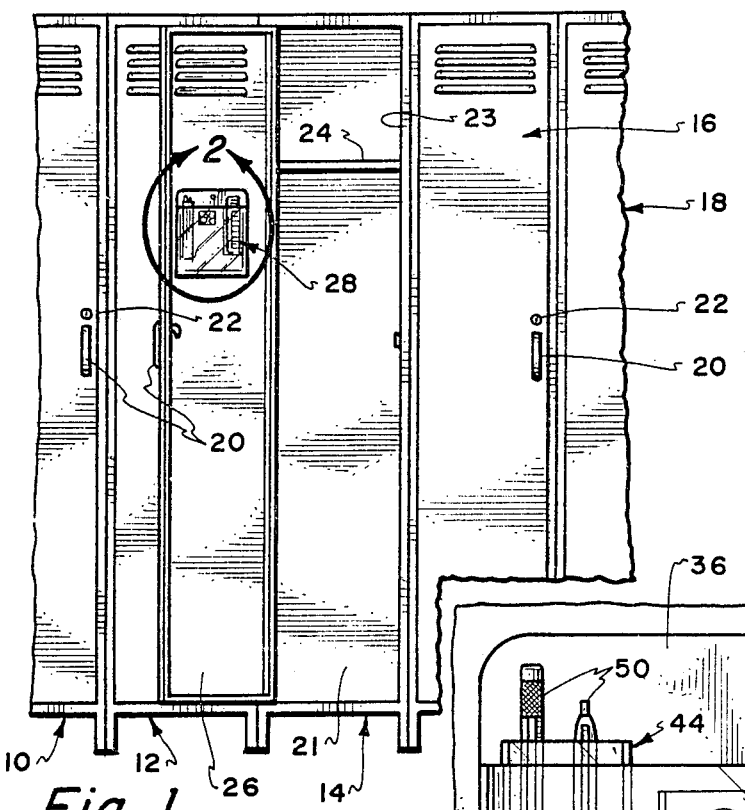
Fig. 1.
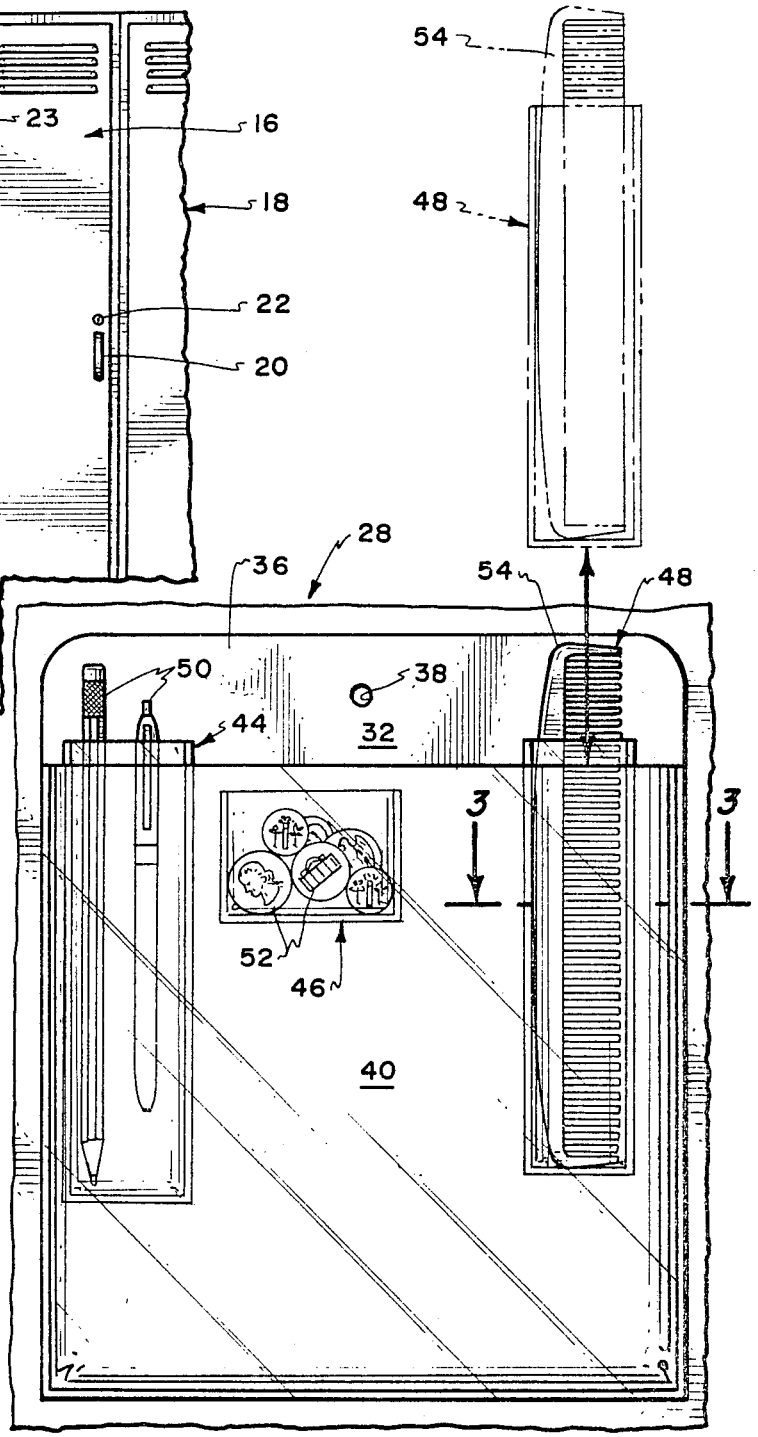
Fig. 2.
Fig. 3.
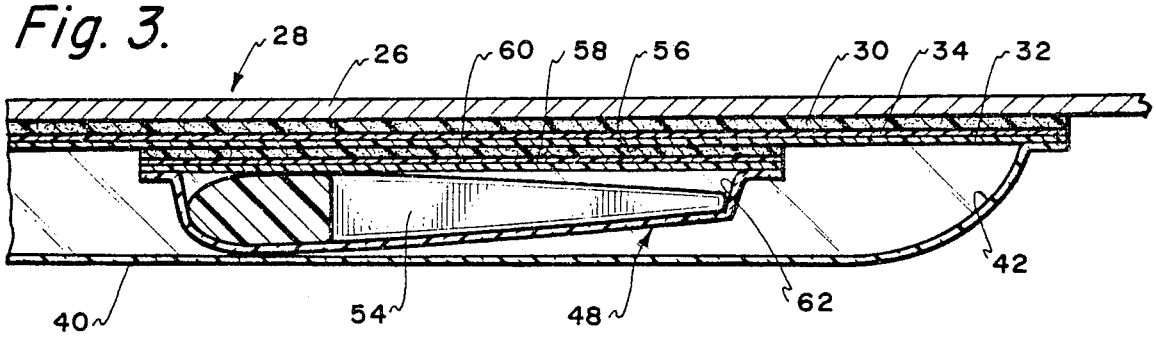

ARTICLE HOLDER

BACKGROUND OF THE INVENTION

The field of the present invention relates to an article holder and more particularly to a bag or pouch-like receptacle adapted to hold personal articles of human beings such as pens, pencils, combs, coins and the like, with the pocket located against a metallic side wall of a locker.

The use of lockers within schools, health clubs and other similar facilities is well-known. A locker is in essence no more than a cabinet that has a door which is openable and can be locked when closed. It is common for there being a locker for each person. The most common material of construction for these lockers is metal.

People generally carry with them a number of different articles. Students generally are required to carry a greater number of articles. Common articles for a student would be pens, pencils, a ruler, a compass, coins, as well as personal hygiene articles such as combs and/or brushes and cosmetics for female students. It is common to locate these items on a shelf within a locker. These small articles end up getting lost in conjunction with larger sized articles such as books that are also located on the shelf.

It would be desirable to design some type of article holder which can be readily mounted within a metal locker which would provide a convenient area for storage of smaller sized articles thereby eliminating the need for storage in other areas of the locker and storage within pocket or purse of the user. Previously, there have been many attempts at designing article holders. However, previously such article holders have been complicated and relatively expensive. In Applicants' opinion there has not been an article holder which has been designed primarily for usage in conjunction with metal lockers.

SUMMARY OF THE INVENTION

The primary objective of the present invention is to construct an inexpensive article holder particularly adapted for holding small sized articles such as pens, pencils, coins, combs and brushes and constructing a holder in such a manner to be quickly and easily connected to a vertical walled surface of a metal locker or other similar type of cabinet.

Another objective of the present invention is to provide an article holder which is configured to receive a variety of different types and sizes of articles of general use eliminating the need for preselecting of a storage location of the article within the holder and permitting the article to be quickly extracted from the holder with a minimum amount of visual observation to the locating of the article.

Another objective of the present invention is to construct the article holder in such a manner as to permit changing the location of article holding compartments if such is deemed to be desired.

The article holder of the present invention is to be constructed of a sheet material housing which is to be constructed of a flexible material such as plastic or the like. This sheet material housing includes an enlarged interior chamber wherein the upper edge of such is formed into a single access opening for the purpose of permitting entry and removal of articles contained within this interior chamber. Location of the articles can be readily ascertained visually since the front wall of the housing is transparent. The back wall of the housing has attached thereto a sheet magnet. This magnet facilitates its location onto a vertical metallic surface such as a side wall of a metallic locker. Within the interior chamber of the housing, there is located a plurality of smaller sized pockets each of which has an access opening at its upper edge. These smaller size pockets are specially configured to hold specialty type articles such as coins, a comb, a pencil or the like. These smaller sized pockets may have strip magnets around the bottom edge and the two side edges and the positions of these pockets is held in place by the magnetic attraction to the strip magnet attached to the back side of the housing. These small pockets can be moved within the interior chamber to various positions, if such is deemed to be desired, and, once positioned in a particular position, will remain in that position until moved again to another position.

BRIEF DESCRIPTION OF THE DRAWING

FIG. 1 is a front view of a series of lockers with one of the doors of the lockers being opened showing the article holder of the present invention being mounted on the inside surface of the door;

FIG. 2 is an enlarged view of the article holder of FIG. 1 taken along line 2—2 of FIG. 1 depicting possible movement of one of the pockets included within the article holder of this invention; and FIG. 3 is a cross-sectional view taken along line 3—3 of FIG. 2.

DETAILED DESCRIPTION OF THE SHOWN EMBODIMENT

Referring particularly to the drawing, there is shown a conventional series of lockers 10, 12, 14, 16 and 18. Each locker 10 through 18 includes a handle 20 and a key operated lock mechanism 22. Each locker 10 through 18 is to be assigned to a separate person and is normally to be usable only by that person or that person's authorization. The inside of the lockers 10 through 18 are identical with therebeing shown in locker 14 an inner main storage compartment 21 and a smaller upper storage compartment 23. A shelf 24 separates the compartments 21 and 23. Mounted on the inside surface of the door 26 of the locker 14 is the article holder 28 of this invention.

In order to fix in position the article holder 28 onto the door 26, there is utilized a magnet in the form of sheet 30. A sheet type of magnet is commercially available and is manufactured by several different sources. Basically, the sheet magnet 30 takes the form of a plastic within which has been embedded magnetized metallic particles. The sheet 30 is merely cut to the desired size.

The back wall 32 of the article holder 28 is secured by adhesive 34 to the sheet 30. The adhesive 34 is located directly adjacent the peripheral edge of the back wall 32. This back wall 32 will be constructed of a heavy plastic material. The back wall 32 may or may not be transparent. This back wall 32 has an upper portion forming a header 36. This header 36 includes a hole 38. The hole 38 can be utilized to mount the article holder 28 on a nail or other similar type of protruding device if such is deemed to be desirable.

The housing of the article holder 28 includes a front wall 40. The peripheral edge of the front wall 40, along the right edge, left edge and the bottom edge, is integrally secured to the back wall 32. This front wall 40 will be constructed of a transparent material. It is to be noted that the height of the front wall 40 is less than the back wall 32 so as to expose the header 36. This difference in height facilitates insertion of articles into and out of the enlarged interior chamber 42 confined between the front wall 40 and the back wall 32.

Located within the interior chamber 42 are a plurality of different sized pockets 44, 46 and 48. Each of these pockets 44, 46 and 48 are identical with the exception that they are of different sizes. It is to be noticed that the pocket 44 is designed primarily to support writing instruments 50, such as pens and pencils. The upper edge of the pocket 44, forming the access opening into the pocket 44, is located in the area of the header 36. The pocket 46 is designed primarily to contain coins 52. It is to be noticed that the access opening into the pocket 46 is located adjacent to the access opening of the enlarged interior chamber 42 but is located spaced from the header 36. The pocket 48 is designed primarily to support a comb 54. Again the access opening into the pocket 48 is located in the area of the header 36.

The edges of the pockets 44, 46 and 48 are fixedly secured to a back wall 60. It is to be noticed that the material of construction of each of the pockets 44, 46 and 48 is also of a transparent material. It may be that the edges of the pockets 44, 46 and 48, that is the right edge and left edge and bottom edge, have fixedly secured by adhesive 58 to the back wall 60 thin strips 56 of the magnetizable material previously mentioned. The use of the strips 56 will result in the pockets 44, 46 and 48 being locatable on a particular selected position and remain in the position with the magnetizeable strips 56 being attached to the magnetized sheet 26 and to the metallic door 26 of the lockers 10 through 18. Also, the use of this "non-fixing" securing arrangement between the pockets 44, 46 and 48 and the back wall 32 of the housing will permit the pockets 44, 46 and 48 to be moved by the user to various locations within the interior compartment 42 or completely removed and used at another location such as within one's pocket or purse. Each pocket 44, 46 and 48 has an interior chamber 12.

What is claimed is:

1. An article holder to be used in conjunction with a metallic locker comprising:

a sheet material housing, said housing being flexible, said housing having an enlarged interior chamber, a single first access opening permitting access into and out of said interior chamber, said enlarged interior chamber being adapted to retain personal articles of human beings;

said locker having a vertically oriented side wall, means for mounting said article holder onto said vertically oriented side wall of said locker;

a plurality of pockets, said pockets being substantially smaller in size than said enlarged interior chamber, each said pocket having a single second access opening, each said pocket being located within said enlarged access opening, each said second access opening being located substantially adjacent said first access opening; and each said pocket being movable to be able to occupy different positions within said interior chamber and also to be removable from said interior chamber.

2. The article holder as defined in claim 1 wherein:

said means for mounting comprising a mounting magnet attached to said article holder.

3. The article holder as defined in claim 2 wherein:

said sheet material housing having a back wall, said back wall having an interior surface and an exterior surface, said interior surface forming a wall surface for said interior chamber, said mounting magnet being mounted on said exterior surface of said back wall.

4. The article holder as defined in claim 3 wherein:

each said pocket being mounted on said interior surface, each said pocket including a position fixing magnet assembly, each said position fixing magnet assembly being located about the periphery of said pocket, each said position fixing magnet assembly being magnetically attracted to said mounting magnet assembly.

5. The article holder as defined in claim 3 wherein:

said sheet material housing having a front wall, said front wall being transparent permitting observation into said interior chamber.

* * * * *